US005244514A

United States Patent [19]

Garde

[11] Patent Number: 5,244,514

[45] Date of Patent: Sep. 14, 1993

[54] CREEP RESISTANT ZIRCONIUM ALLOY

[75] Inventor: Anand M. Garde, West Simsbury, Conn.

[73] Assignee: Combustion Engineering, Inc., Windsor, Conn.

[21] Appl. No.: 835,348

[22] Filed: Feb. 14, 1992

[51] Int. Cl.[5] ..... C22C 16/00

[52] U.S. Cl. ..... 148/421; 148/407; 420/422

[58] Field of Search ..... 148/421, 407; 420/422

[56] References Cited

U.S. PATENT DOCUMENTS

| | | | |
|---|---|---|---|
| 2,872,310 | 2/1959 | Wilhelm | 75/177 |
| 4,649,023 | 3/1987 | Sabol et al. . | |
| 4,876,064 | 10/1989 | Taylor | 420/422 |
| 4,879,093 | 11/1989 | Garde . | |
| 4,963,316 | 10/1990 | Stehle et al. . | |
| 5,023,048 | 6/1991 | Mardon et al. . | |
| 5,080,861 | 1/1992 | Garde | 148/407 |

FOREIGN PATENT DOCUMENTS

| | | |
|---|---|---|
| 3805124 | 8/1989 | Fed. Rep. of Germany . |
| 2626291 | 7/1989 | France . |

OTHER PUBLICATIONS

Grigoriev, V. M., Nikulina, A. V. & Peregud, M. M., "Evolution of Zr-Nb Base Alloys for LWR Fuel Clads", paper represented at the IAEA Technical Committee Mtg on Fundamental Aspects of Corrosion of Zirconium-Base Alloys in Water Reactor Environments, Portland, Oreg., Sep. 11-15, 1989.

Parfenov, B. G., Gerasimov, V. V. and Venediktova, G. I., "Corrosion of Zirconium and Zrconium Alloys", Israel Program for Scientific Translations Jerusalem, p. 119 (1969).

Charquet, D., Gros, J. P., and Wadier, J. F., "The Development of Corrosion Resistant Zirconium Alloys", Proceedings of the International ANS-ENS Topical Meeting on LWR Performance, Avignon, France, Apr. 21-24, 1991, vol. 1, pp. 143-152.

Isobe, T. and Matsuo, Y., "Development of High Corrosion Resistance Zirconium-base Alloys", Zirconium in the Nuclear Industry, 9th International Symposium, ASTM STP 1132, C. M. Eucken and A. M. Garde, Eds., Am. Society for Testing and Materials, Philadelphia, 1991, pp. 346-367.

Fuchs, H. P., Garzarolli, F., Weidinger, H. G., Bodmer, R. P., Meier, G., Besch, O. —A. and Lisdat, R., "Cladding and Structural Material Development for the Advanced Siemens PWR Fuel 'FOCUS'", Proceedings of the International ANS-ENS Topical Mtg. on LWR Fuel Performance, Avignon, France, Apr. 21-24, 1991, vol. 2, pp. 682-690.

(List continued on next page.)

*Primary Examiner*—Upendra Roy

*Attorney, Agent, or Firm*—Ronald P. Kananen; John H. Mulholland

[57] ABSTRACT

A zirconium alloy which imparts good creep strength, while also providing favorable neutron cross section, improved corrosion resistance, low hydrogen uptake and good fabricability is described which contains vanadium in a range of from an amount effective to indicate its greater-than-trace presence up to 1.0 wt %, wherein either limit is typical; niobium in a range of from an amount effective to indicate its greater-than-trace presence up to 1.0 wt %, wherein either limit is typical; antimony in a range of from an amount effective to indicate its greater-than-trace presence up to 0.2 wt %, wherein either limit is typical; tellurium in a range of from an amount effective to indicate its greater-than-trace presence up to 0.2 wt %, wherein either limit is typical; tin in a range of from an amount effective to indicate its greater-than-trace presence up to 0.5 wt %, wherein either limit is typical; iron in a range of 0.2 to 0.5 wt %, typically 0.35 wt %; chromium in a range of from 0.1 to 0.4 wt %, typically 0.25 wt %; silicon in a range of 50 to 200 ppm, wherein either limit is typical; and oxygen in a range of from an amount effective to indicate its greater-than-trace presence up to 2200 ppm, wherein either limit is typical and the balance zirconium.

3 Claims, No Drawings

OTHER PUBLICATIONS

Urbanic, V. F. and Gilbert, R. W., "Effect of Microstructure on the Corrosion on Zr-2.5Nb Alloy", paper presented at the IAFA Technical Committee Meeting on Fundamental Aspects of Corrosion of Zirconium--Base Alloys for Water Reactor Environments, Portland, Oreg., Sep. 11-15, 1989.

Eucken, C. M., Finden, P. T., Trapp-Pritsching, S. and Weidinger, H. G., "Influence of Chemical Composition on Uniform Corrosion of Zirconium Base Alloys in Autoclave Tests", Zirconium in the Nuclear Industry, Eighth International Symposium, ASTM STP 1023, L. F. P. Van Swam and C. M. Eucken, Eds; Am. Society for Testing & Materials, Philadelphia, 1989, pp. 113-127.

McInteer, W. A., Baty, D. L. and Stein, K. O., "The Influence of Tin Content on the Termal Creep of Zircaloy-4", Zirconium in the Nuclear Industry, Eighth International Symposium, ASTM STP 1023, L. F. P. Van Swam & C. M. Eucken, Eds; Am. Soc. for Testing & Materials, Phila., 1989, pp. 621-640.

Scott, D. B., "Notes on the Corrosion Behavior of Zircaloy-2 with Various Levels of Iron Content", Zirconium Highlights, WAPD-ZH-24, p. 11 (1960).

CREEP RESISTANT ZIRCONIUM ALLOY

BACKGROUND OF THE INVENTION

This invention relates to alloys for use in light water nuclear reactor (LWR) core structural components and fuel claddings. More particularly, this invention relates to a zirconium alloy with second phase vanadium precipitates which are stable with respect to neutron exposure and high temperature exposure. Still more particularly, this invention relates to a zirconium alloy having stable second phase vanadium precipitates, while containing tin levels below that of conventional zirconium alloys and various additional alloying elements This alloy is designed to function at high coolant temperatures and discharge burn-ups and to provide acceptable levels of creep resistance, neutron cross section, corrosion resistance, hydrogen uptake and fabricability.

DESCRIPTION OF THE PRIOR ART

Zirconium alloys are used in fuel rod claddings and in fuel assembly structural components of nuclear reactors (e.g., guide or thimble tubes, grid strips, instrument tubes, and so forth) because they exhibit a low neutron cross section, good corrosion resistance against high pressure/high temperature steam and water, and good mechanical strength and fabricability. Zirconium alloys, particularly those commonly known as Zircaloy-2 and Zircaloy-4, have also been used in LWR cores because of their relatively small capture cross section for thermal neutrons. "Zircaloy" is a common name for zirconium-tin alloys. Zircaloy-4, for example, has 0.18 to 0.24 percent by weight (wt %) iron, 0.07 to 0.13 wt % chromium, oxygen in the range of from 1000 to 1600 ppm, 1.2 to 1.7 wt % tin, and the remainder zirconium.

The addition of 0.5 to 2.0 wt % niobium, up to 1.5 wt % tin and up to 0.25 wt % of a third alloying element to zirconium alloys for purposes of corrosion resistance in the reactor core is suggested in U.S. Pat. No. 4,649,023 as part of a teaching for producing a microstructure of homogeneously disbursed fine precipitates of less than about 800 Å. The third alloying element is a constituent such as iron, chromium, molybdenum, vanadium, copper, nickel and tungsten U.S. Pat. No. 5,023,048 describes a fuel rod comprising a cladding tube having an inner tubular layer and an outer surface layer composed of differing zirconium alloys. The inner tubular layer is made from a conventional zirconium alloy such as Zircaloy-4. The outer surface layer is made from a zirconium alloy containing 0.35 to 0.65 wt % tin, 0.2 to 0.65 wt % iron, 0.09 to 0.16 wt % oxygen, and 0.35 to 0.65 wt % niobium or 0.25 to 0.35 wt % vanadium.

Recent trends in the nuclear industry include shifts toward higher coolant temperatures to increase thermal efficiency and toward higher fuel discharge burn-ups to increase fuel utilization. Both the higher coolant temperatures and the higher discharge burn-ups tend to dissolve second phase particles in conventional Zircaloys, and thereby decreasing the creep resistance of these materials. Moreover such conditions increase in-reactor corrosion and hydrogen uptake. Unfortunately, when the level of tin is lowered to improve corrosion resistance for these applications, the creep resistance of these materials is further degraded due to the loss of solid solution hardening.

Accordingly, it is a continuing problem in this art to develop a zirconium alloy having superior creep strength, while providing good corrosion resistance as well as low neutron absorption, reduced hydrogen absorption by the alloy and good fabricability.

SUMMARY OF THE INVENTION

It is, therefore, an object of this invention to provide a zirconium alloy with vanadium precipitates which are stable with respect to neutron exposure as well as high temperature exposure.

It is another object of this invention to provide a zirconium alloy having tin levels below that of conventional Zircaloys.

It is an additional object of this invention to provide a zirconium alloy with an improved creep resistance while maintaining reasonable levels of low neutron cross section, corrosion resistance, low hydrogen uptake and good fabricability.

It is an additional object of this invention to provide a zirconium alloy comprising vanadium (V) in a range of from an amount effective to indicate its greater-than-trace presence up to 1.0 wt %, wherein either limit is typical; niobiu range of from an amount effective to indicate its greater-than-trace presence up to 1.0 wt %, wherein either limit is typical; antimony (Sb) in a range of from an amount effective to indicate its greater-than-trace presence up to 0.2 wt %, wherein either limit is typical; tellurium (Te) in a range of from an amount effective to indicate its greater-than-trace presence up to 0.2 wt %, wherein either limit is typical; tin (Sn) in a range of from an amount effective to indicate its greater-than-trace presence up to 0.5 wt %, wherein either limit is typical; iron (Fe) in a range of 0.2 to 0.5 wt %, typically 0.35 wt %; chromium (Cr) in a range of from 0.1 to 0.4 wt %, typically 0 25 wt %; silicon (Si) in a range of 50 to 200 parts per million (ppm), wherein either limit is typical; oxygen (0) in a range of from an amount effective to indicate its greater-than-trace presence up to 2200 ppm, wherein either limit is typical; and the balance zirconium (Zr).

DESCRIPTION OF THE PREFERRED EMBODIMENT

The invention is based upon the theory that, because of its limited solubility, vanadium will precipitate as $ZrV_2$ and that such precipitates will impart good creep resistance, resist coarsening, exhibit low hydrogen uptake, and be stable under neutron flux and at high burn-ups. Moreover, based on available creep data;, it is theorized that a complex alloy containing many alloying elements, both in solid solution as well as in stable second phase particles, should have superior creep resistance when compared to simple alloys. The reasons for selecting specific levels of various alloying elements are given below, and the composition of the alloy according to an embodiment of the present invention is shown in Table 1.

The zirconium alloy of the present invention, therefore, includes vanadium (V) in a range of from an amount effective to indicate its greater-than-trace presence up to 1.0 wt %, wherein either limit is typical; niobium (Nb) in a range of from an amount effective to indicate its greater-than-trace presence up to 1.0 wt % wherein either limit is typical; antimony (Sb) in a range of from an amount effective to indicate its greater-than-trace presence up to 0.2 wt %, wherein either limit is typical; tellurium (Te) in a range of from an amount effective to indicate its greater-than-trace presence up to 0.2 wt %, wherein either limit is typical; tin (Sn) in a range of from an amount effective to indicate its greater-than-trace presence up to 0.5 wt %, wherein either limit is typical; iron (Fe) in a range of 0.2 to 0.5 wt %, typically 0.35 wt %; chromium (Cr) in a range of from 0.1 to 0.4 wt %, typically 0.25 wt %; silicon (Si) in a range of 50 to 200 ppm wherein either limit is typical; oxygen (O) in a range of from an amount effective to indicate its greater-than-trace presence up to 2200 ppm, wherein either limit is typical; and the balance zirconium (Zr).

Vanadium, in a range of from an amount effective to indicate its greater-than-trace presence to 1.0 wt %, is added as an alloying element to reduce hydrogen uptake.(2) Moreover, due to the fact that the densities of zirconium and vanadium are very close to one another, precipitation of $ZrV_2$ should result in second phase particles that are coherent and will not coarsen or dissolve easily. Finally, additions of vanadium up to 0.4 wt % in zirconium-iron binary alloys has been shown to result in corrosion resistance superior to Zircaloy-4.(3)

Niobium, in an amount from an amount effective to indicate its greater-than-trace presence to 1.0 wt %, is added to improve the corrosion resistance,(4) to improve the irradiated ductility,(5) to reduce the hydrogen absorption,(5) and to increase creep resistance of the new alloy.(6) In concentrations beyond 0.5 wt %, beta niobium will precipitate, with neutron irradiation possibly causing additional precipitation.(7) Niobium also stabilizes irradiated dislocation structures with the formation of niobium-oxygen radiation defect complexes.

Antimony and tellurium, added in amounts ranging from an amount effective to indicate its greater-than-trace presence up to 0.2 wt %, decrease the hydrogen uptake by the alloy.(8) Since the densities of both antimony and tellurium are very close to that of zirconium, second phase particles, if they precipitate, will not coarsen easily.

A decrease in the tin level below the 1.2 wt % lower limit found in Zircaloy-4 improves its corrosion resistance.(9) However, the trend of the mechanical property data regarding the influence of tin content on the thermal creep of zirconium alloys at 400° C. indicates that a decrease in tin level will degrade the creep resistance of zirconium alloys.(10) The selected range of tin level of from an amount effective to indicate its greater-than-trace presence up to 0.5 wt % requires that additional alloying elements be added to prevent such degradation.

The corrosion resistance of Zircaloy-2 and iron alloys in both 360° C. water and 400° C. steam depends on the iron level.(11) While the best corrosion resistance in 360° C. water was observed with 0.45 wt % iron, the best corrosion resistance in 400° C. steam was observed at 0.25 wt % iron. Therefore, iron is added in a range of from 0.2 to 0.5 wt %. In order to achieve good corrosion resistance in both steam and water environments, a preferable intermediate value of 0.35 percent iron may be selected for the new alloy of the invention.

Chromium, in the range of 0.I to 0.4 wt % and typically 0.25 wt %, is added to optimize the corrosion resistance of the new alloy.

Silicon, in a range of 50 to 200 ppm is added as an alloying element to reduce the hydrogen absorption by the alloy and to reduce variations in the corrosion resistance with variations in the processing history of the alloy.(9)

Oxygen, in a range of from an amount effective to indicate its greater-than-trace presence up to 2220 ppm, is added as a solid solution hardening element.

As previously stated, zirconium is desirable as a bulk material due to its favorable neutron cross section, corrosion resistance, mechanical strength and fabricability.

Thus, by its selected composition, the invention of the new alloy described in this disclosure achieves stable second phase particles, which impart good creep resistance, while maintaining low neutron cross section, good corrosion resistance, reduced hydrogen absorption and good fabricability. The exposure of known zirconium alloys to a water reactor environment results in irradiation damage to the second phase particles. This reduces the creep resistance of the irradiated alloys. Moreover, by lowering the tin level to improve corrosion resistance, creep resistance is likewise reduced. A new zirconium alloy, according to this invention, with optimum levels of vanadium, niobium, antimony, tellurium, iron, chromium, silicon, oxygen and tin is proposed to overcome these problems.

BIBLIOGRAPHY (1) Grigoriev, V. M., Nikulina, A. V. and Peregud, M. M., "Evolution of Zr-Nb Base Alloys for LWR Fuel Clads," paper presented at the IAEA Technical Committee Meeting on Fundamental Aspects of Corrosion of Zirconium-Base Alloys for Water Reactor Environments, Portland, Oregon, Sep. 11-15, 1989.

(2) parfenov, B. G., Gerasimov, V. V. and Venediktova, G. I., *Corrosion of Zirconium and Zirconium Alloys,* Israel Program for Scientific Translations, Jerusalem, p. 119 (1969).

(3) Charquet, D., Gros, J. P., and Wadier, J. F., "The Development of Corrosion Resistant Zirconium Alloys," *Proceedings of the International ANS-ENS Topical Meeting on LWR Fuel Performance,* Avignon, France, Apr. 21-24, 1991, Vol. 1, pp. 143-152.

(4) Isobe, T. and Matsuo, Y., "Development of High Corrosion Resistance Zirconium-base Alloys," *Zirconium in the Nuclear Industry, 9th International Symposium, ASTM STP* 1132, C. M. Eucken and A. M. Garde, Eds., American Society for Testing and Materials, Philadelphia, 1991, pp. 346-367.

(5) Garde, A. M., U.S. Pat. No. 4,879,093, "Ductile Irradiated Zirconium Alloy," issue date Nov. 7, 1989.

(6) Fuchs, H. P., Garzarolli, F., Weidinger, H. G., Bodmer, R. P., Meier G., Besch, O. A. and Lisdat, R., "Cladding and Structural Material Development for the Advanced Siemens PWR Fuel 'FOCUS'," *Proceedings of the International ANS-ENS Topical Meeting on LWR Fuel Performance,* Avignon, France, Apr. 21-24, 1991, Vol. 2, pp. 682-690.

(7) Urbanic, V. F. and Gilbert, R. W., "Effect of Microstructure on the Corrosion of Zr-2.5Nb Alloy," paper presented at the IAEA Technical Committee Meeting on Fundamental Aspects of Corrosion of Zirconium-Base Alloys for Water Reactor Environments, Portland, Oregon, Sep. 11-15, 1989.

(8) Garde, A. M., U.S. Pat. No. 5,080,861, "Zirconium Alloy with Superior Corrosion Resistance at Extended Burnups," issue date Jan. 14, 1992.

(9) Eucken, C. M., Finden, P. T., Trapp-Pritsching, S. and Weidinger, H. G., "Influence of Chemical Composition on Uniform Corrosion of Zirconium Base Alloys in Autoclave Tests," *Zirconium in the Nuclear Industry Eighth International Symposium,* ASTM STP 1023, L. F. P. Van Swam and C. M. Eucken, Eds; American Society for Testing and Materials, Philadelphia, 1989, pp. 113–127.

(10) McInteer, W. A., Baty, D. L. and Stein, K. O., "The Influence of tin content on the Thermal creep of Zircaloy-4," *Zirconium in the Nuclear Industry, Eighth International Symposium,* ASTM STP 1023, L. F. P. Van Swam and C. M. Eucken, Eds; American Society for Testing and Materials, Philadelphia, 1989, pp. 621–640.

(11) Scott, D. B., "Notes on the Corrosion Behavior of Zircaloy-2 with Various Levels of Iron Content," *Zirconium Highlights,* WAPD-ZH-24, p. 11 (1960).

TABLE 1

| | Preferred Embodiment of the Zirconium Alloy | |
|---|---|---|
| | Range | Typical |
| Vanadium, wt % | An amount effective to indicate its greater-than-trace presence up to 1.0% | same |
| Niobium, wt % | An amount effective to indicate its greater-than-trace presence up to 1.0% | same |
| Antimony, wt % | An amount effective to indicate its greater-than-trace presence up to 0.2% | same |
| Tellurium, wt % | An amount effective to indicate its greater-than-trace presence up to 0.2% | same |
| Tin, wt % | An amount effective to indicate its greater-than-trace presence up to 0.5% | same |
| Iron, wt T | 0.2 to 0.5% | 0.35% |
| Chromium, wt % | 0.1 to 0.4% | 0.25% |
| Silicon, ppm | 50–200 ppm | same |
| Oxygen, ppm | An amount effective to indicate its greater-than-trace presence up to 2200 ppm | same |

I claim:

1. A zirconium alloy for use in light water nuclear core structure elements and in fuel cladding, which comprises a composition as follows:

vanadium, in a range from an amount effective to indicate its greater-than-trace presence up to 1.0 wt %;

niobium, in a range from an amount effective to indicate its greater-than-trace presence up to 1.0 wt %;

antimony, in a range from an amount effective to indicate its greater-than-trace presence up to 0.2 wt %;

tellurium, in a range from an amount effective to indicate its greater-than-trace presence up to 0.2 wt %;

tin, in a range of from an amount effective to indicate its greater-than-trace presence up to 0.5 wt %;

iron, in a range of 0.2 to 0.5%;

chromium, in a range of 0.1 to 0.4%;

silicon, in a range of 50 to 200 ppm;

oxygen, in a range of an amount effective to indicate its greater-than-trace presence up to 2200 ppm; and zirconium, constituting the balance of said composition.

2. The alloy as set forth in claim 1, wherein said chromium concentration is about 0.25 wt %.

3. The alloy as set forth in claim 1, wherein said iron concentration is about 0.35 wt %.

* * * * *